United States Patent [19]

Elliott et al.

[11] Patent Number: 4,867,896

[45] Date of Patent: Sep. 19, 1989

[54] CLEANING COMPOSITIONS CONTAINING CROSS-LINKED POLYMERIC THICKENERS AND HYPOCHLORITE BLEACH

[75] Inventors: David L. Elliott, Hawthorne; Laura A. Kiefer, Bogota, both of N.J.

[73] Assignee: Lever Brothers Company, New York, N.Y.

[21] Appl. No.: 157,425

[22] Filed: Feb. 17, 1988

[51] Int. Cl.[4] ..... B11D 3/395

[52] U.S. Cl. ..... 252/94; 252/105; 252/174.23; 252/174.24; 252/99; 252/315,4; 252/187.26; 252/187.34

[58] Field of Search ..... 252/135, 94, 95, 174.23, 252/174.24, 187.26, 187.34, 105, 99, 315.01, 315.1

[56] References Cited

U.S. PATENT DOCUMENTS

| | | | |
|---|---|---|---|
| 2,798,053 | 7/1957 | Brown | 260/2.2 |
| 2,810,716 | 10/1957 | Markus et al. | 260/88.1 |
| 2,985,625 | 5/1961 | Jones | 260/78 |
| 3,544,488 | 12/1970 | Corte et al. | 260/2.2 |
| 3,579,455 | 5/1971 | Sabatelli et al. | 252/135 |
| 4,147,650 | 4/1979 | Sabatelli et al. | 252/135 |
| 4,228,048 | 10/1980 | Tesdahl | 260/17.4 |

FOREIGN PATENT DOCUMENTS

| | | |
|---|---|---|
| 2163447 | 2/1986 | United Kingdom . |
| 2164350 | 3/1986 | United Kingdom . |

*Primary Examiner*—Josephine Barr

*Attorney, Agent, or Firm*—Milton L. Honig

[57] ABSTRACT

Liquid or gel-type cleaning compositions are reported containing a water-soluble polymer formed from monomers comprising at least one $\alpha$, $\beta$-unsaturated carboxylic acid or salt thereof and one or more cross-linking monomers each having at least two unsaturated groups and which after cross-linking consists of a saturated hydrocarbon or aromatic structure. The polymer must be stable to oxidation by 1% hypochlorite at 25° C. for greater than two weeks without exhibiting any phase separation or greater than 50% viscosity loss from the composition. Besides polymer, the compositions will contain a chlorine bleach agent.

13 Claims, No Drawings

CLEANING COMPOSITIONS CONTAINING CROSS-LINKED POLYMERIC THICKENERS AND HYPOCHLORITE BLEACH

BACKGROUND OF THE INVENTION

1. Field of the Invention

The invention relates to liquid cleaning compositions containing polymeric thickeners and hypochlorite generating bleach.

2. The Prior Art

Polymeric thickeners are often added to liquid products to enhance rheological solution properties including viscosity and yield point. Specifically, the thickeners must meet the properties of water solubility, stability toward hypochlorite oxidation, and retention of viscosity building properties. Special problems arise with the thickeners when the liquid products also contain a hypochlorite bleach.

Cross-linked or pseudo cross-linked polymers have been known as efficient viscosifiers because they form extended networks in solution. These network forming polymers are particularly useful as gelling agents or for suspension of solid particles. Examples of such materials are the natural gums including tragacanth and xanthan. Synthetic cross-linked polymers have been described in numerous patents and been commercially available for many years.

U.S. Pat. No. 2,798,053 (Brown) discloses a water dispersible cross-linked interpolymer of a monomeric polymerizable alpha-beta monoolefinically unsaturated lower aliphatic carboxylic acid with a polyether of a polyol. The polyol is selected from oligosaccharides, reduced derivatives thereof and pentaerythritol, the hydroxyl groups of the polyol being modified with at least two allyl ether groups per molecule. These materials are commercially available from The B. F. Goodrich Company under the trademark of Carbopol ® resins.

U.S. Pat. No. 2,810,716 (Markus et al.) describes acrylic acid polymers cross-linked with polyunsaturated compounds including trivinyl benzene and 2,5-dimethyl-3,4-dihydroxy-1,5-hexadiene.

U.S. Pat. No. 2,985,625 (Jones) discloses water thickening compositions useful in cleaning products which are insoluble but highly hydrophilic interpolymers. At least three monomers combine to produce these interpolymers. Illustrative of these thickeners are terpolymers combining maleic anhydride, a vinyl alkyl ether or acrylic derivative, and a cross-linking agent with more than one polymerizable olefinic bond. Substances such as polyallyl sucrose, polyallyl pentaerythritol, and polybutadiene (with a plurality of side $CH_2{=}CH$ groups) are suggested as cross-linking agents.

U.S. Pat. No. 4,228,048 (Tesdahl) suggests use of modified polyacrylic acid salt in liquid cleaning compositions containing sodium hypochlorite. Especially preferred is a polyallyl sucrose modified polyacrylic acid salt identified as Carbopol 941 ®.

A number of patents have reported use of linear sodium polyacrylate in chlorine bleach containing cleaning compositions. Linear polyacrylate was not, however, used for its thickening properties but rather to improve protection of the overglaze layer on fine china. See GB 2 164 350A (Lai et al.) and GB 2 163 447A (Colarusso). In U.S. Pat. No. 4,147,650, sodium polyacrylate was included in a mechanical dishwashing formulation alongside sodium hypochlorite and sodium tripolyphosphate. Polyacrylate was found to extend the water softening properties of the tripolyphosphate. U.S. Pat. No. 3,579,455 (Sabatelli et al.) reports use of a polyacrylate in a dishwashing composition reporting this polymer to be useful for reducing spotting and improving clarity on glassware.

Liquids containing hypochlorite bleach are especially destructive to most synthetic and natural polymers. In fact, only linear polyacrylates have been found to have even marginal stability in solutions containing active chlorine. Furthermore, water-soluble polymers, such as the linear polyacrylates, are often susceptible to phase separation in highly alkaline or high ionic strength aqueous systems.

Those of the aforementioned compositions incorporating non-cross-linked polyacrylate and the like polymers have not suggested that they enhance viscosity; indeed, these linear polymers do not significantly enhance viscosity. Those of the aforementioned patents reporting hypochlorite compositions, such as U.S. Pat. No. 4,228,048, have not addressed the problem of oxidative degradation of the polymer thickener. For instance, Carbopol 941 ® is excellent at thickening but has very poor resistance to oxidation.

Currently available naturally derived network-forming polymers are incompatible with hypochlorite. Polysaccharides such as cellulose, xanthan and gum tragacanth, all having numerous hydroxyl groups and either linkages, degrade rapidly in the presence of active chlorine. Commercial synthetic polymers such as Alcogum SL-70 ® and Ucar ® resins contain urethane linkages which render these materials susceptible to both degradation and phase separation in high ionic strength, bleach-containing solutions. Carbopol ® resins lose a large portion of their gelforming ability and phase separate after less than one week of hypochlorite contact. Acrysol ICS-1 ® and the Acrysol ASE ® resins show similar behavior. Thus, polymeric thickeners are needed which can maintain adequate performance under harsh, long-term storage conditions found with bleach containing household products.

Accordingly, it is an object of the invention to provide a liquid hypochlorite detergent product which is adequately thickened with a polymer.

A further object of the invention is to provide a hypochlorite containing detergent product having a thickening polymer resistant to bleach induced degradation.

A further object of the invention is to provide a liquid or gel type detergent composition useful as an automatic dishwashing product.

A still further objective of the invention is to obtain a polymeric thickener for hypochlorite containing compositions which not only has chemical and physical stability relative to all components but is also soluble in aqueous media.

These and other objects of the present invention will become apparent as further details are provided in the subsequent discussion and Examples.

SUMMARY OF THE INVENTION

A liquid or gel-type cleaning composition is provided comprising:

(i) a water-soluble polymer formed from monomers comprising at least one $\alpha$, $\beta$-unsaturated carboxylic acid or salt thereof and one or more cross-linking monomers each having at least two unsaturated groups and which after crosslinking consists of a saturated hydrocarbon or aromatic structure, said polymer being stable to oxidation by 1% hypochlorite at 25° C. for greater than two weeks without exhibiting any phase separation or greater than 50% loss in viscosity from said composition; and (ii) a chlorine containing bleach compound present in an amount to provide about 0.1 to 5% of available chlorine by weight of the composition; said cleaning composition having a viscosity on a Haake Rotovisco RV-100 Viscometer at 25° C. under 5 $sec^{-1}$ shear of from about 500 to 20,000 cps and under 21 $sec^{-1}$ shear of from about 200 to 5,000 cps.

Particularly preferred polymers are those formed from the monomer combination of acrylic or methacrylic acid with trivinylcyclohexane and acrylic or methacrylic acid with 1,5-hexadiene.

DETAILED DESCRIPTION OF THE INVENTION

Polymers disclosed herein have been specifically tailored to withstand hypochlorite attack. There are at least two components which form the polymers of the invention. These are: (1) a vinyl carboxylic acid monomer present in a major amount in the final polymer, and (2) a cross-linking monomer having at least two vinyl or allylic groups per monomer. Optionally, other monomer units may be included which complement or alter properties of the two primary components. These components are polymerized using free radical initiation by such compounds as azobisdiisobutyronitrile, benzoyl peroxide, azobisdimethylvaleronitrile, or other common initiators known to the art.

The primary component in the polymers disclosed here is a vinyl or acrylic monomer with pendant carboxylic acid moieties. Preferred monomers are acrylic acid or methacrylic acid and their derivatives. Other monomers can also be used including maleic acid or maleic anhydride, itaconic acid, crotonic acid, or fumaric acid. The primary monomer components should promote water solubility in the final polymer. Alkali-metal salt derivatives of the resultant polymers are preferred because they normally will have increased water-solubility, highly efficient thickening and improved chlorine-bleach stability. Primary monomer or combinations thereof may be present between 25 and 99.9 weight %, preferably between 40 and 99.9 weight % based upon the final polymer weight.

The second component is a monomer containing at least two vinyl, allylic or alkenyl groups. This component must assist in forming a three-dimensional network when copolymerized. No functional groups readily susceptible to hypochlorite degradation should be present in the resulting polymer. Illustrative of such susceptible groups are esters, ethers, amides, amines, hydroxyl and other oxygen and/or nitrogen hetero atom groups. Groups which would be compatible and in certain structures desirable are $-SO_3-M^+$, $-OSO_3-M^+$, chloro, bromo and mixtures thereof, where $M^+$ is a metal cation. For instance, the presence of a chloro atom in proximity to a vinyl group may improve the extent of cross-linking.

Examples of cross-linking monomers are divinylbenzene, trivinylbenzene, 1,2,4-trivinylcyclohexane, 1,5-hexadiene, and 1,4-hexadiene. In addition, any diene, triene or tetraene can be used which is resistant to hypochlorite attack in its saturated form, for example, 1,5,9-decatriene, 1,9-decadiene, 1,5-heptadiene, etc. Furthermore, polymers or oligomers which contain vinyl or allylic groups in the backbone or as pendant groups can be used as the cross-linking agents. Examples of this class of cross-linking agent are polymers and copolymers of 1,3-butadiene or isoprene, with polybutadiene being preferred. Optimum molecular weight of these polymers is 300 to 4,000, with 500 to 2,000 most preferred. A post cross-linking hydrogenation treatment is especially important for the polybutadiene type polymers to eliminate residual unsaturation.

The cross-linking component should be present in the polymer between 0.1 and 15 weight %, preferably between 0.1 and 8 weight %, optimally between 0.2 and 4 weight %. Higher amounts of the cross-linking agent (>1%) in the polymer require special procedures to insure uniform distribution of the cross-links in the resultant material. At concentrations of cross-linking monomer less than 1%, normal batch-type procedures can be employed; however, at concentrations greater than 1%, a precipitation polymerization technique must be used and the cross-linking agent must be added stepwise over the course of the reaction to insure optimum cross-link density.

Optionally, further monomer components can be incorporated into the polymers of this invention. These monomers can include any vinyl, acrylic, or alkenyl monomer which polymerizes by free radical initiation and which displays good hypochlorite stability when incorporated into a polymer chain. Examples of such monomers are maleic anhydride, alkyl acrylates or methacrylates, styrene or alkylene monomers such as butene. These further components can be incorporated into the polymers between 0 and 75 weight %, preferably between 0 and 40 weight %.

The polymers form gels when neutralized to pH=7 in aqueous dispersions (0.1–1.5 weight % polymer) with viscosity in the range of 100 to 50,000 cps in water at 21 $sec^{-1}$, and 100 to 30,000 cps at 21 $sec^{-1}$ in 0.1M NaCl solution. Dispersions of the polymers in water (0.1–1.5 weight % polymer) have thixotropic character and yield stress values in the range of 5–150 Pa in water. Swelling indices for the polymers in water range between 50 and 2,000 and in salt water between 50 and 300. Swelling index is defined as the ratio of polymer weight plus absorbed water to the dry polymer weight.

The polymeric thickener of this invention may be present in an amount from about 0.1 to about 10%, preferably from about 0.4 to 2%, optimally between about 0.6 and 1.5% by weight of the cleaning composition.

One manner of insuring oxidation resistance is to post-treat the formed polymers with a reducing agent. For example, reduction may be performed by hydrogenation over a transition metal catalyst such as sponge nickel, palladium, platinum or rhodium. Hydrides may also be used as reducing agents. These may be selected from sodium hydride, calcium hydride, lithium hydride, sodium aluminum hydride, sodium borohydride, sodium amide, diborane, alkyl and alkoxy aluminum hydrides, alkyl and alkoxy borohydrides, alkyl and alkoxy sodium aluminum hydrides, diimide and mixtures thereof. Another form of reducing agent may be the salts of bisulfite, hydrosulfite, metabisulfite, sulfite and mixtures thereof. Alkali metal salts are particularly preferred. Reduction of any residual unsaturation in the polymer may also be accomplished by treatment with elemental bromine.

When the cleaning compositions of this invention are intended for a gel-type product, it is desirable for the composition to be elastic or non-dripping. When tilting a container upright again after pouring, the discharging gel should exhibit a memory, recoiling back into the container without leaving any drop of liquid around the container mouth.

A physical measure of this elasticity or recoil is $J_e^o$, the steady state compliance value. $J_e^o$ is derived from steady state viscoelastic deformation measurements performed through well known standard techniques (see J. Ferry, "Viscoelastic Properties of Polymers", Third Edition, John Wiley & Sons, New York, 1980). $J_e^o$ reflects the elastic deformation and/or energy stored in the elastic components of a fluid during steady flow. This value identifies the extent to which a fluid rebounds when stress is removed. Rebounding or recoil is a property associated with visual perception of elasticity. The $J_e^o$ value should be greater than about 0.01 meters$^2$/Newton, preferably greater than about 0.02 meter$^2$/Newton, and optimally between 0.02 and 0.10.

Both liquid and gel-type forms of compositions described by this invention should possess certain flow properties. Thus, the compositions should possess under the minimum shear conditions of 5 sec$^{-1}$ at 25° C., a viscosity of from about 500 to 20,000 cps, preferably from about 1,500 to 10,000 cps, optimally between 3,000 and 7,000 cps. Under flow conditions represented by the shear rate of 21 sec$^{-1}$ at 25° C., the viscosity should range from about 200 to 5,000 cps, preferably from about 300 to 4,000 cps, optimally from 400 to 2,500 cps. The aforementioned viscosities are measured on a Haake Rotovisco RV-100 Viscometer.

Compositions of this invention will contain a chlorine oxidizing or bleach agent. Traditionally, liquid dishwashing compositions have for this purpose utilized sodium hypochlorite because it is inexpensive. Other oxidizing agents may, however, be employed under certain circumstances. For instance, in a gel-type product it is possible to utilize encapsulated heterocyclic N-bromo and N-chloro imides such as trichlorocyanuric, tribromocyanuric, dibromo and dichlorocyanuric acids, and salts thereof with water solubilizing cations such as potassium and sodium. An example of a hydrated dichlorocyanurate acid is Clearon CDB 56, a product manufactured by the Olin Corporation. The bleach material will be present in the composition from about 0.1 to 2% by weight. Preferred concentrations will provide about 0.1 to about 5 weight % available chlorine, preferably 0.2 to 4 weight %, optimally between 0.8 and 1.5 weight %.

Alkali metal tripolyphosphate, pyrophosphate, carbonate and mixtures of these materials will also normally be present in the product. These builders will range in concentration from about 8 to about 50 weight %, preferably about 10 to 35%, optimally between about 20 and 30 weight %. Sodium or potassium tripolyphosphate and carbonate mixtures are particularly preferred.

Smectite clays may be incorporated into compositions of the present invention to assist in structuring product. These clays may include the montmorillonite clays such as bentonite, hectorite, saponite and similar materials. These clays are available under trade names such as Gelwhite GP® and Thixogel® No. 1, both from Georgia Kaolin Company.

Attapulgite clays may also be used and are commercially available under the name Attagel from Engelhard Minerals and Chemicals Corporation. Mixtures of smectite and attapulgite types in the weight ratios from 4:1 to 1:5 may also be useful.

Automatic dishwashing detergent compositions based upon this invention will also contain sodium or potassium silicate. This material is employed as a cleaning ingredient, source of alkalinity, metal corrosion inhibitor, and protector of glaze on china tableware. Especially effective is sodium silicate having a ratio of $SiO_2$:$Na_2O$ from about 1.0 to about 3.3, preferably from about 2 to about 3.2. The silicate may be used in the form of an aqueous liquor or a solid. It will be present from about 0.1 to 30%, more preferably from about 5 to 20% by weight of the composition.

Surfactants are desirably part of the aforementioned compositions. These surfactants should be of the low-foaming type where the composition is intended for automatic dishwasher use; foam interferes with the dishwasher cleaning action. Suitable surfactants may be selected from nonionic, anionic and amphoteric types and mixtures thereof.

Nonionic surfactants can be broadly defined as compounds produced by the condensation of alkylene oxide groups with an organic hydrophobic material which may be aliphatic or alkyl aromatic in nature.

Low foaming anionic surfactants are especially useful for this invention when combined with effective defoaming materials. Anionics are desirable because they are more stable towards hypochlorite then the nonionic type. Illustrative of this category are alkyl diphenyloxide sulfonate, alkyl naphthalene sulfonate, sodium 2-acetamidohexadecane sulfonate and nonionic alkoxylates having a sodium alkylene carboxylate moiety linked to a terminal hydroxy group of the nonionic through an ether bond.

Surfactants will usually be present in an amount from about 0.1 to 25%, preferably from about 0.15 to 5%, optimally from about 0.2 to 3% by weight of the composition.

Defoaming of the wash may be accomplished by the presence of any of a number of commercially available defoaming agents. These agents may be of the general type of slightly soluble alkyl carboxylates, alkyl phosphates, hydrocarbon waxes, hydrophobic silicas, silicone defoamers, or many others. In addition to being an effective defoamer, the species must be stable to hypochlorite. The defoamer will optionally be present in the composition from about 0.05% to 5%, preferably from about 0.1 to 1%, and most preferably from about 0.1 to 0.5% by weight of the composition.

Amounts of water present in the liquid compositions should neither be so high as to produce unduly low viscosity and fluidity, nor so low as to produce unduly high viscosity and low flowability, thixotropic properties in either case being diminished or destroyed. Water will generally be present in an amount ranging from about 25 to 80%, preferably from about 45 to 75%, optimally from about 55 to 65% by weight of the composition.

An alkali metal hydroxide will be used as an alkaline source and as a means to boost the pH to stabilize hypochlorite. The optimal pH of the product will be between 11.5 and 12.5. Amounts of sodium hydroxide will range from about 0.1 to 10%, preferably about 0.5 to 5%, and optimally about 1 to 2% by weight of the composition.

Minor amounts of various other adjuvants may be present in the composition. Thus, the compositions may include perfumes, flow control agents, soil suspending agents, antiredeposition agents, anti-tarnish agents, and other functional additives.

Although the compositions of this invention have been specifically designed for automatic dishwashing compositions and the foregoing specification has detailed such formulated products, it must be emphasized that the polymeric thickener and hypochlorite combinations can be utilized for other purposes. Thus, it is envisioned that the composition of this invention may be useful in products such as fabric washing formulations, toilet bowl scrubs, pot/pan cleaners, denture cleaners and hard surface cleaners.

The following examples will more fully illustrate the embodiments of this invention. All parts, percentages and proportions referred to herein and in the appended claims are by weight unless otherwise indicated.

EXAMPLE 1

Preparation of a 97:3 Acrylic Acid/Trivinylcyclohexane Copolymer

Into a 500 ml, three-necked round-bottom flask equipped with a cold finger, additon funnel, and mechanical stirrer were charged approximately 230 ml of hexane and 36.92 ml of acrylic acid. The flask was placed in a water bath at 25° C. and purged with nitrogen for 45 minutes. Next, 1.44 ml of 1,2,4-trivinylcyclohexane (TVCH) was placed in an addition funnel and diluted to 60 ml with hexane which had been stored under nitrogen. The water bath temperature was raised to reflux temperature (65°-70° C.) and 6 ml (10%) of the TVCH solution was added to the reaction mixture. The reaction was initiated with 0.5 weight % benzoyl peroxide which had been dissolved in 50 ml hexane. After approximately 5 minutes reaction time, a white precipitate began to form. At this time, the remaining TVCH solution was added incrementally over a 1-hour period. The reaction was allowed to continue 30–45 minutes after the addition was complete. Product was vacuum-filtered through a fine fritted glass filter, washed with cold hexane, and dried in a vacuum oven at 70° C. After grinding, the product was a finely-divided white powder.

The polymer forms 1 weight % dispersions in water with viscosity of 25,000 cps at 5 $sec^{-1}$ and a swelling index of 750. Dispersions of this polymer in water and in salt water are transparent.

EXAMPLE 2

Preparation of a 96:4 Acrylic Acid/1,5-Hexadiene Copolymer

The same procedure was followed as in Example 1 but 36.54 ml of acrylic acid was used with 1.61 g of 1,5-hexadiene (HD). The resultant polymer formed clear, gel-like solutions in water and in salt water. Dispersions of the polymer in water (1 weight %) had a viscosity of 11,000 cps at 5 $sec^{-1}$ and a swelling index of 605.

EXAMPLE 3

Preparation of a 85:12:3 Acrylic Acid/Methyl Acrylate/1,5-Hexadiene Terpolymer Into a 500 ml, three necked round-bottom flask equipped with a cold-finger, addition funnel, and mechanical stirrer were charged approximately 230 ml of hexane, 32.35 ml of acrylic acid, and 5 ml of methyl acrylate. The flask was placed in a water bath at 25° C. and purged with nitrogen for 45 minutes. Next, 1.26 ml of 1,5-hexadiene (HD) was placed in an addition funnel and diluted to 60 ml with hexane which had been stored under nitrogen. The water bath temperature was raised to reflux temperature (65°-70° C.) and 6 ml (10%) of the HD solution was added to the reaction mixture. The reaction was initiated with 1.0 weight % benzoyl peroxide which had been dissolved in 50 ml of hexane. After a white precipitate began forming (about 5 minutes), the remaining HD solution was added incrementally over a 1-hour period. After addition of the HD solution was complete, the reaction was allowed to proceed for 30 minutes. Product was filtered, washed with hexane, dried under vacuum, and ground into a fine white powder.

EXAMPLE 4

Polymeric thickeners of the present invention were evaluated in a representative clay-based liquid automatic dishwashing detergent. The formulation is outlined below.

Clay-Based Liquid Automatic Dishwashing Detergent

| Component | Weight % Actives | Grams |
|---|---|---|
| Water | 61.87 | 195.6 |
| Polymer* | 0.20 | 0.80 |
| Sodium Hydroxide (50 weight % in water) | 0.11 | 0.88 |
| Gelwhite GP | 2.00 | 8.00 |
| Sodium Tripolyphosphate | 21.36 | 85.44 |
| Sodium Carbonate | 7.00 | 28.00 |
| RU Silicate | 6.46 | 54.96 |
| Sodium Hypochlorite (aqueous) | 1.00 | 26.32 |
| | 100.00% | 400.00 g |

*Polymer used here contains 97 weight % acrylic acid with 3 weight % 1,5-hexadiene.

The polymer was sifted into the water in a 600 ml beaker at 60° C. After gel formation, the sodium hydroxide, Gelwhite GP (clay), sodium tripolyphosphate, sodium carbonate, and sodium silicate, were added consecutively, allowing 2–5 minutes between each addition to insure complete mixing. Thereafter, the beaker was cooled to 30° C., after which was added the hypochlorite. Then the mixture was stirred at room temperature for 5 minutes. A slurry resulting therefrom was an off-white, creamy mixture having a viscosity of 5800 cps at 5 $sec^{-1}$ and 1800 cps at 21 $sec^{-1}$ after 8 weeks of storage. After 8 weeks, the mixture retained 0.85% available chlorine (15% hypochlorite loss).

EXAMPLE 5

A formulation was made similar to that of Example 4, except the polymer was a 96:4 acrylic acid and trivinylcyclohexane copolymer. The resulting slurry was a creamy mixture with viscosity of 5900 cps at 5 $sec^{-1}$ and 1500 cps at 21 $sec^{-1}$ after 8 weeks of storage. Hypochlorite stability was again excellent, with retention of 0.84% available chlorine after 8 weeks (16% loss of hypochlorite).

EXAMPLE 6

Micellar Polymerization of Acrylic Acid and Trivinylcyclohexane

Into a 1000 ml, three-necked, round-bottom flask equipped with a mechanical stirrer were charged 500 ml of deionized water, 37.9 ml of acrylic acid. Nitrogen was used to purge the solution for 45 minutes. Upon removal of the nitrogen atmosphere, the flask was placed in a water bath at 50° C. Thereto was added 0.2 g TVCH and 10.5 g sodium lauryl sulfate. To initiate the reaction, there was added 0.02 g potassium persulfate; polymerization was allowed to continue for 24 hours. After about 4–6 hours, the reaction mixture became viscous. The polymer was then neutralized with an equimolar amount of sodium hydroxide and precipitated twice from acetone. A rubbery, solid mass formed as the precipitate and was cut into small pieces with scissors. This polymer was swelled in water and freeze-dried. After freeze drying, the product was a pliable, low-density solid. Liquid nitrogen was used to freeze the material which was then ground into a fine, white powder.

EXAMPLE 7

Gel-type automatic dishwashing compositions are herein illustrated. A typical formula is outlined below.

Gel-Type Automatic Dishwashing Composition

| Component | Weight % Actives | g Added |
|---|---|---|
| Water | 61.3 | 63.44 |
| Potassium Hydroxide | 1.0 | 2.00 |
| Tetrapotassium pyrophosphate | 20.0 | 40.00 |
| Polymer (4% in water) | 1.0 | 50.00 |
| Aluminum Sulfate | 0.2 | 0.40 |
| Potassium Carbonate | 6.0 | 12.00 |
| Britesil H20 ® | 7.5 | 15.00 |
| Surfactant | 2.0 | 4.00 |
| Sodium Hypochlorite (aqueous) | 1.0 | 13.16 |
| | 100.0% | 200.00 g |

Samples were prepared by mixing the components at room temperature in the order shown, with additional mixing until the formulation was clear. The samples were then stored at 25° C. and at 40° C. Formulations containing polymers of this invention were compared to one with Carbopol 941 ® for hypochlorite loss (by titration) and visible degradation (usually denoted by any phase separation or greater than 50% loss of viscosity). Results of these tests are given in the tables below.

TABLE I

Comparison of Carbopol ® and Invention Polymers at 25° C.

| Time (weeks) | Carbopol 941 ® | 97% AA 3% TVCH | 96% AA 4% TVCH | 95% AA 5% TVCH | 97% AA 3% HD |
|---|---|---|---|---|---|
| 0 | 1.02 | 1.02 | 1.00 | 1.00 | 1.00 |
| 1 | 1.05* | 0.98 | 1.00 | 0.84 | 1.00 |
| 2 | 0.97 | 0.91 | 0.93 | 0.87 | 1.00 |
| 3 | 0.93 | 0.82* | 0.89 | 0.86 | 0.91 |
| 4 | — | — | —* | —* | —* |

*Point in time at which visible degradation is first noticeable.
AA—Acrylic Acid
TVCH—1,2,4-trivinylcyclohexane
HD—1,5-hexadiene Results as reported by Table I show that the polymers of this invention were more resistant to oxidation than Carbopol 941 ® allowing the formula to retain its gel appearance upon storage. It is, however, seen that hypochlorite loss was often faster than in the Carbopol ® containing solution.

TABLE II

Comparison of Carbopol and Invention Polymers at 40° C.

| Time (weeks) | Carbopol 941 ® | 97% AA 3% TVCH | 96% AA 4% TVCH | 95% AA 5% TVCH | 97% AA 3% HD |
|---|---|---|---|---|---|
| 0 | 1.02 | 1.03 | 1.00 | 1.01 | 1.00 |
| 1 | 1.00* | 1.03 | 1.00 | 0.60 | 1.00 |
| 2 | 0.74 | 0.61* | 0.90 | 0.47 | 0.87 |
| 3 | — | 0.51 | 0.70* | 0.35* | 0.69* |

*Point in time at which visible degradation is first noticeable.
AA—Acrylic Acid
TVCH—1,2,4-trivinylcyclohexane
HD—1,5-hexadiene Similar results were observed at 40° C. See Table II. The polymers of the present invention were seen to have greater resistance to hypochlorite degradation than Carbopol 941 ®. In all cases, the rate of degradation was accelerated due to the higher temperature.

EXAMPLE 8

Formulations of gel-type automatic dishwashing compositions were prepared according to Example 7 utilizing the same ingredients and amounts but reducing sodium hypochlorite to 0.1 weight %. The samples were stored at 25° C. and 40° C. and compared for hypochlorite loss and visible degradation. Results are shown in Table III.

TABLE III

Comparison of Carbopol ® and Invention Polymers at Low Hypochlorite Levels at 25° C.

| Time (weeks) | Carbopol 941 ® | 97% AA 3% TVCH | 96% AA 4% TVCH | 98.5% AA 4% PBD |
|---|---|---|---|---|
| 0 | 0.10 | 0.10 | 0.10 | 0.10 |
| 1 | 0.08* | 0.08 | 0.09 | 0.10 |
| 2 | 0.07 | 0.08 | 0.07 | 0.01 |
| 3 | — | 0.06 | 0.05 | 0.01* |
| 4 | — | 0.01* | 0.01* | — |

Point in time at which visible degradation is first noticeable.
AA—Acrylic Acid
TVCH—1,2,4-trivinylcyclohexane
HD—1,5-hexadiene
PDB—polybutadiene Resulsts as reported in Table III indicate that the rate of degradation was similar to examples exposed to 1% hypochlorite. However, polymers of the present invention again show about 2–4 times greater resistance to degradation than Carbopol ®. Results at 40° C. also show similar behavior to the previous Examples, i.e. accelerated rates of chlorine loss and degradation.

EXAMPLE 9

A number of commercially available polymers suggested as thickening agents have been evaluated for compatibility, stability and thickening performance in the gel-type formula of Example 7. Table IV summarizes the results.

TABLE IV

| Polymer Thickener (Supplier) | Polymer Identity | Compatibility | Oxidation Stability | Thickening Performance |
|---|---|---|---|---|
| Acrysol ASE-108 (Rohm and Haas) | Cross-linked Poly(acrylate/methacrylic acid) | None | N/A | Poor |
| Acrysol ASE-60 (Rohm and Haas) | Cross-linked Poly(acrylate/methacrylic acid) | None | N/A | Poor |

TABLE IV-continued

| Polymer Thickener (Supplier) | Polymer Identity | Compatibility | Oxidation Stability | Thickening Performance |
|---|---|---|---|---|
| PPE-1042 (Nat. Adh. and Resins) | Cross-linked Poly(acrylate/methacrylic acid) | None | N/A | Poor |
| Viscalex HV-30 (Allied Colloids) | Cross-linked Poly(acrylate/methacrylic acid | Slight | <1 week | Poor |
| Narlex EP-3 (National Starch & Chemical) | Linear polyacrylamide emulsion | None | N/A | Poor |
| Natrosol Plus (Hercules) | Hydroxyethyl Cellulose | None | N/A | Poor |
| Waterlock G-400 (Grain Processing Co.) | Cross-linked Polyacrylic Acid | Slight | <1 week | Poor |
| Carbopol 941 ® (B. F. Goodrich) | Allyl Pentaerythritol Cross-Linked Polyacrylic Acid | Good | <1 week | Good |
| Kelzan S (Kelco) | Xanthan Gum | Good | <1 week | Good |
| Clarifloc C-326 (Allied) | Linear polyacrylamide | Slight | <1 week | Poor |

Formulations containing the polymers of Table IV were first evaluated for compatibility. The term "none" of the Table indicates that there was no perceptible dissolution of the polymer in the composition and it precipitated to the bottom within 24 hours. Dissolution to an extent less than 50% was accorded the grade of "slight" compatibility. Where compatibility was "good", a clear gel was formed.

Oxidation stability was tested at 25° C. storage only for those polymers which had compatibility. The term "N/A" indicates non-compatibility and therefore oxidation measurements could not be performed.

Finally, thickening performance was measured against a criteria where a rating of "poor" was applied to compositions with less than 500 cps viscosity. "Good" ratings were applied to those compositions with viscosity greater than 1000 cps at 25° C.

From Table IV, it is evident that very few commercial polymers are compatible with aqueous chlorine bleach containing systems such as those of Example 7. Even where there is some compatibility, the materials fall quite short of having stability against hypochlorite oxidation.

The foregoing description and examples illustrate selected embodiments of the present invention. In light thereof, variations and modifications will be suggested to one skilled in the art, all of which are within the spirit and purview of this invention.

What is claimed is:

1. A liquid or gel cleaning composition comprising:

(i) a water-soluble polymer formed from 25 to 99.9 wt. % of monomers comprising at least one $\alpha$, $\beta$-unsaturated carboxylic acid or salt thereof selected from the group consisting of acrylic acid, methacrylic acid, maleic anhydride, their salts and mixtures thereof, and from 0.1 to 15 wt. % of at least one cross-linking monomer each having at least two unsaturated groups selected from the group consisting of trivinylcyclohexane, 1,5-hexadiene, trivinylbenzene, divinylbenzene and polybutadiene and which after crosslinking consists of a saturated hydrocarbon or aromatic structure, said polymer being stable to oxidation by 1% hypochlorite at 25° C. for greater than two weeks without exhibiting any phase separation or greater than 50% loss in viscosity from said composition; and (ii) a chlorine containing bleach compound present in an amount to provide about 0.1 to 5% of available chlorine by weight of the composition; said cleaning composition having a viscosity on a Haake Rotovisco RV-100 Viscometer at 25° C. under 5 $sec^{-1}$ shear of from about 500 to 20,000 cps and under 21 $sec^{-1}$ shear of from about 200 to 5,000 cps.

2. A composition according to claim 1 wherein said polymer contains three or more different monomer units.

3. A composition according to claim 2 wherein said polymer also comprises a $C_1$–$C_{22}$ alkyl ester of acrylic or methacrylic acid.

4. A composition according to claim 1 wherein said polymer is formed from polyacrylic or polymethacrylic acid and salts thereof cross-linked with trivinylcyclohexane.

5. A composition according to claim 1 wherein said polymer is formed from acrylic or methacrylic acid and salts thereof cross-linked with 1,5-hexadiene.

6. A composition according to claim 1 wherein said polymer is formed from acrylic or methacrylic acid and salts thereof, methyl acrylate, together cross-linked with 1,5-hexadiene.

7. A composition according to claim 1 wherein said polymer is formed from acrylic or methacrylic acid and salts thereof, and maleic anhydride or salts thereof, together cross-linked with trivinylcyclohexane.

8. A composition according to claim 1 having a $J_e^o$ value greater than 0.01 $meters^2$/Newton.

9. A composition according to claim 8 wherein the $J_e^o$ ranges from about 0.02 to 0.1 $meters^2$/Newton.

10. A composition according to claim 1 wherein said chlorine bleach is selected from sodium hypochlorite and alkali metal dichloroisocyanurate.

11. A composition according to claim 1 wherein said composition viscosity at 25° C. under 5 $sec^{-1}$ shear ranges from about 3,000 to about 7,000 cps and under 21 $sec^{-1}$ shear ranges from about 400 to about 2,500 cps.

12. A composition according to claim 1 wherein said monomers comprising at least one $\alpha$, $\beta$-unsaturated carboxylic acid or salt are present from 40 to 99.9 wt. % based upon the final polymer weight.

13. A composition according to claim 1 wherein the cross-linking monomer is present from between 0.2 and 4 wt. % based upon the final polymer weight.

* * * * *